US006608248B1

(12) United States Patent
Sperzel

(10) Patent No.: US 6,608,248 B1
(45) Date of Patent: Aug. 19, 2003

(54) DEVICE FOR TUNING A STRING OF A MUSICAL INSTRUMENT

(76) Inventor: Robert J. Sperzel, 7810 Lake Ave., Cleveland, OH (US) 44102

( * ) Notice: Subject to any disclaimer, the term of this patent is extended or adjusted under 35 U.S.C. 154(b) by 0 days.

(21) Appl. No.: 10/102,118

(22) Filed: Mar. 20, 2002

(51) Int. Cl.[7] ..... G10D 3/14
(52) U.S. Cl. ..... 84/306; 84/304; 84/305
(58) Field of Search ..... 84/304, 305, 306

(56) References Cited

U.S. PATENT DOCUMENTS

| | | | | |
|---|---|---|---|---|
| 3,431,807 A | | 3/1969 | Thompson | |
| 3,830,132 A | * | 8/1974 | Lowe | 84/304 |
| 4,353,280 A | | 10/1982 | Spercel | |
| 4,625,614 A | | 12/1986 | Spercel | |
| 4,748,889 A | * | 6/1988 | Schaller | 84/304 |
| 5,728,955 A | | 3/1998 | Sperzel | |
| 6,023,014 A | | 2/2000 | Sperzel | |

FOREIGN PATENT DOCUMENTS

| | | |
|---|---|---|
| DE | 185015 | 6/1906 |
| GB | 22701 | 10/1908 |
| GB | 231064 | 3/1925 |

* cited by examiner

*Primary Examiner*—Kimberly Lockett
(74) *Attorney, Agent, or Firm*—Tarolli, Sundheim, Covell & Tummino L.L.P.

(57) ABSTRACT

A device for tuning a string of a musical instrument includes a pinion which is connected with a string post and a worm which is disposed in meshing engagement with the pinion. An annular groove may extend around the string post. A slot may extend inward from an end of the string post. A string passage includes a central passage which extends only part way through the string post and has an end surface area disposed in the string post at a location adjacent to a bottom surface of the slot. A transverse passage extends only part way through the string post and intersects the central passage. The transverse passage has an opening in the annular groove. The bottom of the slot in the string post may be skewed at an acute angle relative to a central axis of the string post.

23 Claims, 4 Drawing Sheets

DEVICE FOR TUNING A STRING OF A MUSICAL INSTRUMENT

BACKGROUND OF THE INVENTION

The present invention relates to a tuning device for a string of a musical instrument, such as a guitar or a banjo.

Known musical instruments have devices which are actuatable to obtain a desired tension in a string of the musical instrument. Devices for changing the tension in a string of a musical instrument during playing of the musical instrument are disclosed in U.S. Pat. No. 6,023,014.

Regardless of whether or not the tension in a string of a musical instrument is changed during playing of the musical instrument, it is important that a desired tension be maintained when playing the musical instrument. Therefore, it is important that the string of the musical instrument be securely held by the device which tensions the string. However, in order to facilitate use of a musical instrument, it is important that a desired tension be quickly and easily obtainable in the string of the musical instrument.

Tension has previously been obtained in a string of a musical instrument by inserting the string of the musical instrument through a passage which extends diametrically through a string post and is disposed in an annular groove in the string post. The string post is connected with a pinion which is disposed in meshing engagement with a worm., A knob connected with the worm may be manually rotated to rotate the string post and wrap the string of the musical instrument at least part way around the string post. Known tuning devices having this general construction are disclosed in U.S. Pat. Nos. 3,431,807; 4,353,280; and 5,728,955.

Other known tuning devices have central passages which extend part way through a string post to a transverse passage which extends through an axial end portion of the string post. A string extends through the transverse passage. A string clamp assembly includes a pin which is disposed in the central passage and is pressed against the string to clamp the string in place. Tuning devices having this construction are disclosed in U.S. Pat. Nos. 4,625,614 and 6,023,014.

It has previously been suggested that a string of a musical instrument could extend from a slot in an end portion of a string post, through an axial passage in the string post, and through a pinion disposed in meshing engagement with a worm. A tuning device having this construction is disclosed in U.S. Pat. No. 4,625,614. Other known devices for use in tuning a string of a musical instrument are disclosed in German Patent No. 185,015 and in British Patent No. 22,701.

SUMMARY OF THE INVENTION

The present invention provides a tuning device for a string of a musical instrument. The tuning device includes a string post. A pinion is connected with a first end of the string post. A worm is disposed in meshing engagement with the pinion. A knob is connected with the worm and is manually rotatable to rotate the pinion and the string post.

A string passage forms one feature of a plurality of features of the invention. The string passage includes a central passage which extends along a central axis of the string post. The central passage extends only part way through the string post. In addition, the string passage includes a transverse passage which intersects the central passage and extends only part way through the string post. The transverse passage may have a central axis which is skewed at an acute angle relative to a central axis of the central passage.

In accordance with another one of the features of the invention, a slot extends from an end of the string post. The slot may have a bottom surface which extends through and is skewed at an acute angle to the central axis of the string post.

In accordance with another one of the features of the invention, an annular groove extends around the string post. The string passage may have an open end which is disposed in the annular groove. It is contemplated that, if desired, the bottom surface of the slot may have an end which is disposed at an intersection between the slot and the annular groove.

It should be understood that various features of the invention may be used separately or in combination with each other. For example, the string passage may be utilized without the aforementioned slot and annular groove. Alternatively, the slot and/or annular groove may be utilized without the string passage. Of course, features of the invention may be utilized in association with many different features of known devices for tuning a string of a musical instrument.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC ONE PREFERRED EMBODIMENT

General Description

Figure 1:
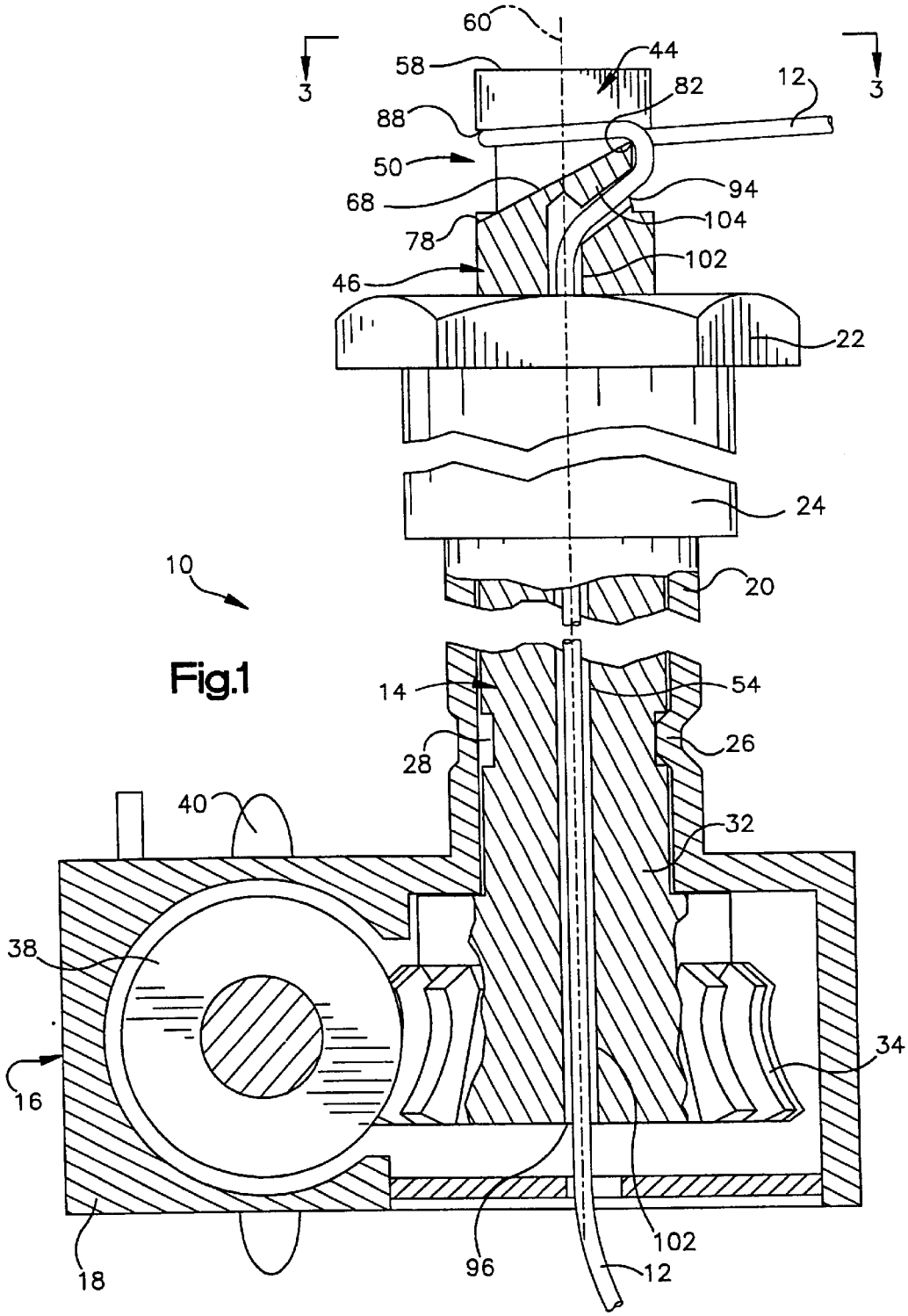
FIG. 1 is an enlarged schematic sectional view of a device constructed in accordance with the present invention to tune a string of a musical instrument.

A tuning device 10 for a string 12 of a musical instrument is illustrated in FIG. 1. The tuning device 10 is mounted on a head portion of a stringed musical instrument. Although the stringed musical instrument may have any desired construction, it is contemplated that the tuning device may be utilized with a stringed musical instrument of the guitar or banjo type. Of course, the tuning device 10 could be utilized in association with other known stringed musical instruments.

The tuning device 10 may be one of a plurality of tuning devices mounted on the head portion of a musical instrument in the manner disclosed in U.S. Pat. No. 6,023,014. Alternatively, the tuning device 10 could be mounted on the head portion of a musical instrument in a manner similar to that disclosed in U.S. Pat. Nos. 4,191,086; 4,643,069; and/or 5,539,144.

A string 12 is connected with the tuning device 10. The string 12 may extend from the head of the musical instrument to a bridge, such as a known tremolo bridge system illustrated in U.S. Pat. No. 4,625,614. Prior to playing of the musical instrument, the tuning device 10 is manually actuated so that the string 12 has the desired pitch. When the musical instrument with which the tuning device 10 is associated is played, the tremolo bridge system may be actuated to vary the tension in the string 12 of the tuning device in a known manner. Of course, the tuning device 10 may be used with known bridge systems which are not tremolo bridge systems.

The tuning device 10 includes a generally cylindrical string post 14 (FIG. 1). The metal string post 14 extends through the head portion of the associated musical instrument and is connected with the string 12.

A metal housing 16 has a base portion 18 and an upstanding tubular portion 20. A metal nut 22 on the tubular portion 20 is fixedly connected with a sleeve 24 having an internal thread which cooperates with an external thread on the tubular portion 20 of the housing 16. The tubular portion 20 of the housing 16 is indented at 26 to engage an annular groove 28 in the string post 14 to retain the string post against vibration during playing of the musical instrument. The manner in which the housing 16 encloses the string post 14 is the same as is disclosed in U.S. Pat. No. 4,353,280.

A lower (as viewed in FIG. 1) end portion 32 of the string post 14 is fixedly connected with a pinion 34. In the embodiment illustrated in FIG. 1, the metal string post 14 is integrally formed as one piece with the metal pinion 34. Therefore, a lower end of the string post 14 is disposed at the upper end of the pinion 34. However, it is contemplated that the string post 14 could be formed separately from the pinion 34 and connected with the pinion in the manner disclosed in U.S. Pat. No. 3,431,807. Of course, the string post 14 could be connected with the pinion 34 in a different manner if desired.

A metal worm 38 is rotatably supported in the base portion 18 of the housing 16. The worm 38 is disposed in meshing engagement with the pinion 34. A manually engageable metal knob 40 is fixedly connected with the worm 38 and is manually rotatable to rotate the worm and pinion 34 relative to the housing 16. Since the string post 14 is fixedly connected with the pinion 34, the string post 14 rotates with the pinion relative to the housing 16 when the knob 40 is manually rotated.

It is contemplated that the housing 16 may have any desired configuration. For example, the housing 16 could have a configuration similar to the configuration disclosed in U.S. Design Pat. No. 256,471. Alternatively, the housing 16 could have a configuration similar to the configuration illustrated in U.S. Pat. Nos. 4,353,280 and/or 6,023,014.

Figure 2:
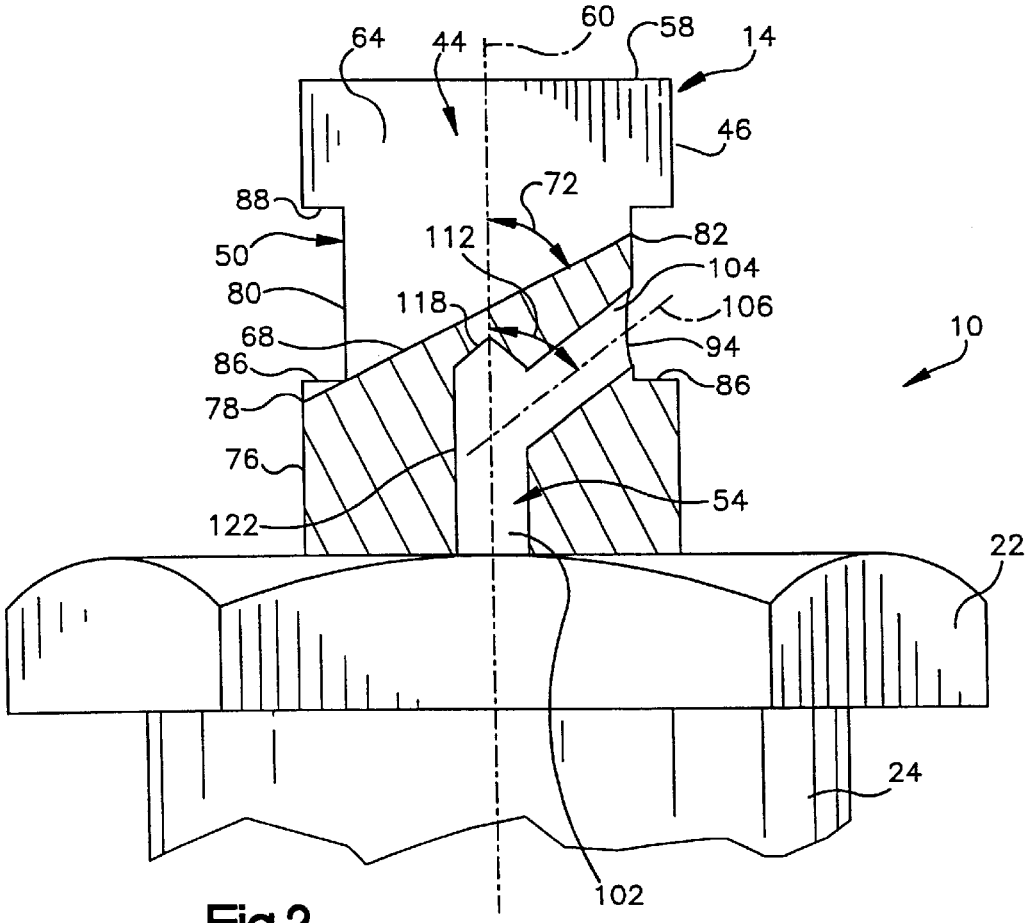
FIG. 2 is an enlarged illustration of a portion of FIG. 1, the string of the musical instrument being eliminated for purposes of clarity of illustration.

The string 12 extends through a slot 44 (FIGS. 1–4) in an upper end portion 46 of the string post 14. The string 12 extends from the slot 44 into an annular groove 50 (FIGS. 1, 2 and 4) which extends around the upper end portion 46 of the string post 14. The annular groove 50 has a generally rectangular configuration as viewed in a plane extending along a diameter of the annular groove (FIG. 2). However, it is contemplated that the annular groove 50 could have a different configuration if desired. For example, the annular groove 50 could have an arcuate configuration similar to the configuration disclosed in the aforementioned U.S. Pat. Nos. 4,353,280 and/or 6,023,014.

The string 12 extends from the annular groove 50 into a string passage 54 (FIGS. 1 and 2). The string passage 54 extends only part way through the string post 14 and through the pinion 34.

The slot 44, annular groove 50, and string passage 54 cooperate to securely grip the string 12 (FIG. 1) and maintain tension in the string during playing of the musical instrument on which the tuning device 10 is mounted. The convoluted path along which the string 12 extends through the slot 44, annular groove 50, and string passage 54 holds the string against pulling loose during playing of the musical instrument on which the tuning device 10 is disposed. This eliminates the necessity for the use of locking knobs and pins in association with a string post in a manner similar to that disclosed in U.S. Pat. Nos. 4,625,614 and 6,023,014. In addition, the slot 44, annular groove 50, and string passage 54 cooperate to grip the string 12 in such a manner as to enable a musician playing the musical instrument on which the tuning device 10 is disposed to quickly and easily tune the musical instrument.

Slot

The slot 44 extends diametrically across the string post 14 (FIG. 3) and extends axially inward from an upper end 58 (FIG. 2) of the string post. The slot 44 intersects the central axis 60 of the string post. The annular groove 50 has a center of curvature disposed on the central axis 60 of the string post. Therefore, the slot 44 also extends diametrically across the annular groove 50.

The slot 44 has flat parallel side surfaces 64 and 66 (FIG. 3) which extend axially inward from the upper end 58 and extend across the upper end portion 46 of the string post 14. The side surfaces 64 and 66 are spaced equal distances from and extend parallel to the central axis 60 of the string post 14. In addition, the slot 44 has a flat bottom surface 68 (FIG. 2) which extends between and is perpendicular to the side surfaces 64 and 66 (FIG. 3) of the slot.

The flat side surfaces 64 and 66 of the slot 44 are disposed on opposite sides of and extend parallel to the central axis 60 of the string post 14. However, the bottom surface 68 extends through the central axis 60 of the string post 14. The bottom surface 68 of the slot 44 is skewed at an acute angle, indicated at 72 in FIG. 2, relative to the central axis 60 of the string post 14. The angle 72 is approximately 60°. However, the angle 72 could have a different size if desired.

The bottom surface 68 of the slot 44 slopes upward and toward the right (as viewed in FIG. 2). The bottom surface 68 of the slot 44 intersects the cylindrical outer side surface 76 of the string post 14 at a lower edge or corner 78. Similarly, the bottom surface 68 of the slot 44 intersects a cylindrical bottom surface 80 of the annular groove 50 at an upper edge or corner 82.

The bottom surface 68 of the slot 44 intersects an annular lower side 86 of the groove 50. However, the upper edge 82 of the slot is disposed below (as viewed in FIG. 2) a flat annular upper side 88 of the groove 50. The upper edge or corner 82 of the bottom surface 68 of the slot 44 is disposed below the upper side 88 of the groove 50 by a distance which is approximately the same as the diameter of the string 112 (FIG. 1). The lower edge 78 of the slot 44 is spaced further from the up per end 58 of the string post 14 than the upper edge 82 of the slot 44.

The string 12 is bent over the upper edge or corner 82 of the slot 44. However, the string 12 is spaced from the lower edge or corner 78 of the slot 44. Since the string 12 engages the upper side 88 of the annular groove 50, the upper side 88 of the annular groove and upper edge 82 of the slot 44 are effective to determine the distance between the string 12 and an upper side surface of a head end portion of a musical instrument on which the tuning device 10 is disposed.

Figure 3:
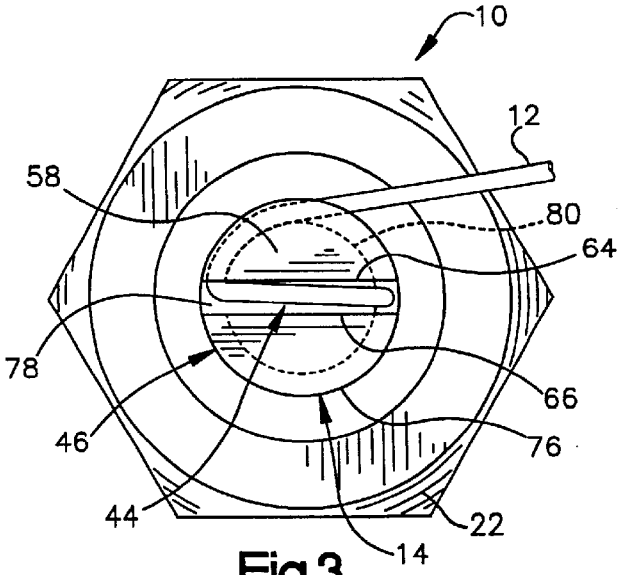
FIG. 3 is a schematic plan view, taken generally along the line 3—3 of FIG. 1, on a reduced scale, further illustrating the manner in which the string of the musical instrument cooperates with the tuning device.

The flat parallel side surfaces 64 and 66 of the slot 44 are spaced apart by a distance which is greater than the thickness of the string 12 (FIG. 3). The string 12 extends through the slot 44 in a spaced apart relationship with the bottom surface 68 of the slot (FIG. 1). However, the string 12 engages the upper edge or corner 82 of the slot 44 at the intersection between the slot 44 and the bottom surface 80 (FIG. 2) of the annular groove 50. Since the string 12 is disposed in engagement with the annular upper side 88 of the groove 50, the string 12 is spaced from the bottom surface 68 of the slot 44 and from the lower side 86 of the groove 50.

String Passage

The string passage 54 extends only part way through the string post 14. The string passage 54 extends through the pinion 34. The string passage 54 has a circular upper (as viewed in FIG. 2) opening 94 (FIG. 4) in the bottom surface 80 of the annular groove 50. In addition, the string passage 54 has a circular lower (as viewed in FIG. 1) opening 96 formed in the pinion 34.

It should be understood that, if the string post 14 extends axially through the pinion 34, the lower opening 96 would be formed in a lower end of the string post. If this is done, a splined interference connection could be formed between the lower end portion of the string post 14 and the pinion 34. However, it is believed that it may be preferred to form the string post 14 integrally with the pinion 34 in order to simplify assembly of the tuning device 10 and to minimize the possibility of loosening of a joint between the string post and pinion.

Figure 5:
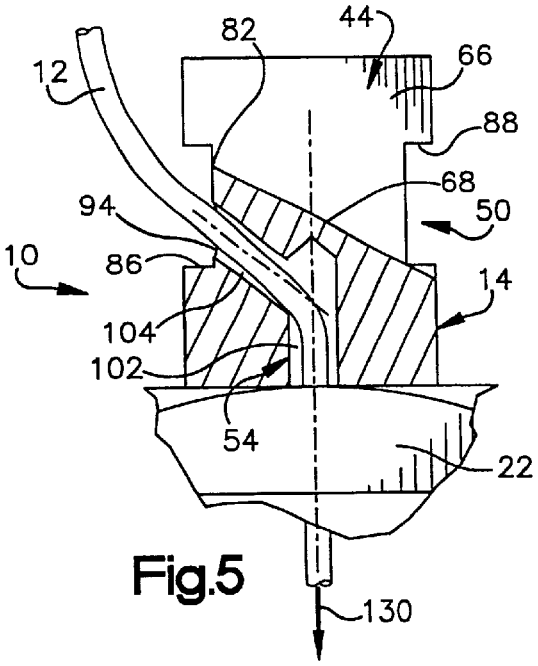
FIG. 5 is a schematic illustration, on a reduced scale, illustrating the manner in which a string is inserted into a passage in the string post of FIGS. 1–4.

The upper opening 94 (FIGS. 2 and 5) to the string passage 54 is disposed in the cylindrical bottom surface 80 of the annular groove 50. The upper opening 94 to the string passage 54 is disposed beneath (as viewed in FIG. 2) the upper edge or corner 82 formed between the bottom surface 68 of the slot 44 and the bottom surface 80 of the groove 50. The upper opening 94 to the string passage 54 is disposed in axial alignment with the upper edge 82 of the slot 44 (FIG. 5).

Since the upper opening 94 to the string passage 54 is disposed in alignment with the upper edge or corner 82 of the slot 44, the string 44 is bent around the upper edge or corner 82 (FIG. 1) and extends straight downward (as viewed in FIGS. 1 and 4) from the edge or corner 82. The string 12 then extends downward and leftward (as viewed in FIG. 1) into the string passage 54. This results in the relatively sharp corner formed by the upper edge 82 of the bottom surface 68 of the slot 44 biting into or at least being pressed into firm engagement with the string 12. By bending the string around the upper edge or corner 82 and through the upper opening 94 to the string passage 54, in the manner illustrated in FIG. 1, the string is securely gripped and held during playing of a musical instrument.

This enables a desired tension to be maintained in the string 12 during playing of a musical instrument.

Figure 4:
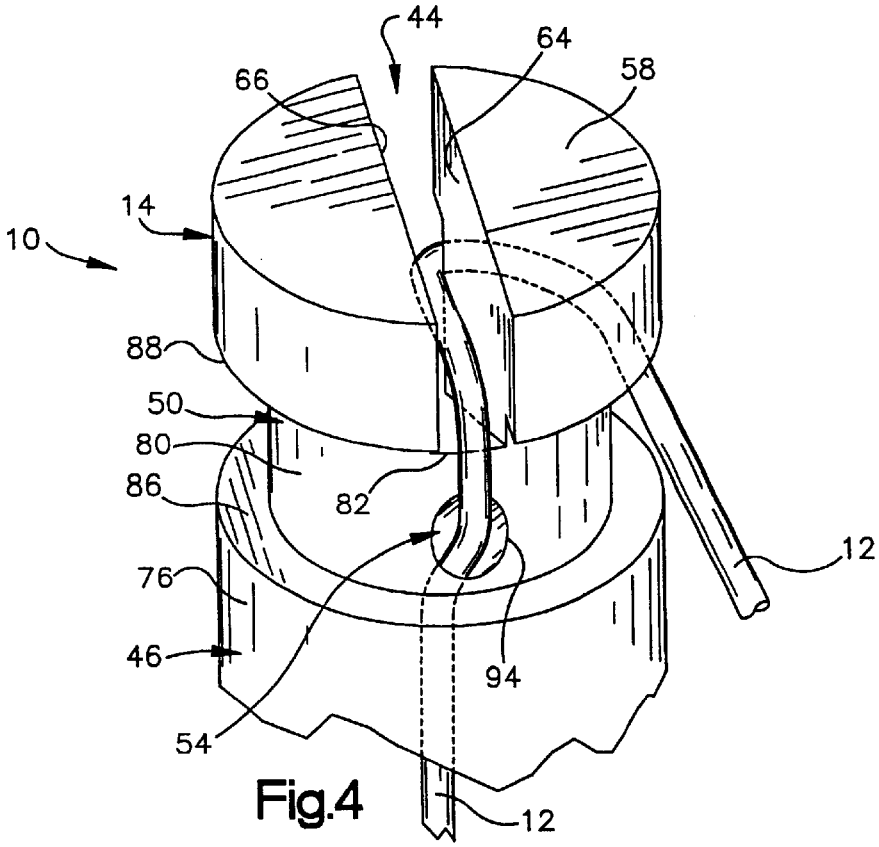
FIG. 4 is a schematic pictorial illustration depicting the relationship of the musical instrument string of FIGS. 1 and 3 to an end portion of a string post of the tuning device.

When the string 12 is tightened by rotation of the knob 40, worm 38, pinion 34 and string post 14, the string 12 is wrapped around at least a portion of the bottom surface 80 (FIG. 2) of the annular groove 50 (see FIGS. 3 and 4). Although the string 12 may be wrapped for a plurality of turns around the upper end portion 46 of the string post 14, it is contemplated that it will be desired to have the string 12 extend for a relatively short distance around the bottom surface 80 of the annular groove 50, in the manner illustrated in FIGS. 3 and 4. This eliminates any possibility of shifting of coils or turns of the string 12 around the string post 14 during playing of a musical instrument connected with the tuning device 10.

The string passage 54 includes a central passage 102 (FIGS. 1 and 2) having a central axis which is coincident with the central axis 60 of the string post 14. In addition, the string passage 54 includes a transverse passage 104 having a central axis 106 (FIG. 2) which intersects the coincident central axes 60 of the string post 14 and central passage 102. The transverse passage 104 is relatively short and extends radially outward and axially upward (as viewed in FIG. 2) from the central passage 102 to the bottom surface 80 of the annular groove 50.

The central axis 106 of the transverse passage 104 extends at an acute angle 112 to the coincident central axes 60 of the string post 14 and central passage 102. The central axis 106 of the transverse passage 104 is skewed relative to a plane containing the bottom surface 68 of the slot 44 and intersects the plane of the bottom surface 68 of the slot. Thus, the acute angle 112 between the central axis 60 of the string post 14 and the central axis 106 of the transverse passage 104 is smaller than the acute angle 72 between the bottom surface 68 of the slot 44 and the central axis 60 of the string post 14. The angle 112 is approximately 45° while the angle 72 is approximately 60°. Of course, the angles 112 and 72 could be of a size which is different than the aforementioned sizes. Although the open end 94 of the transverse passage 104 is offset downward (as viewed in FIGS. 2 and 4) from the bottom surface 68 of the slot 44, the central axis 106 of the transverse passage 104 intersects a radial central axis of the slot 44.

The string passage 54 is formed by the intersecting central passage 102 and transverse passage 104. The central passage 102 and transverse passage 104 have cylindrical configurations and have the same diameter. In the illustrated embodiment, the central passage 104 extends along the central axis 60 of the string post 14 and has an end surface 118 disposed in the string post below (as viewed in FIG. 2) the bottom surface 68 of the slot 44. Thus, the central passage 102 extends only part way through the string post 14.

The transverse passage 104 extends radially and inward and downward (as viewed in FIG. 2) from the annular groove 50. The transverse passage has an end surface 122 disposed in the string post 14 adjacent to a longitudinally extending side of the central passage 102. Thus, the transverse passage 104 extends only part way through the string post 14 The central axis 60 of the central passage 102, the central axis 106 of the transverse passage 104, and a transverse axis of the slot 44 extending perpendicular to the axis 60 are all disposed in a single plane. The center of the circular opening 94 to the transverse passage 104 is disposed on the axis 106.

In the embodiment illustrated in FIG. 2, the transverse passage 104 and central passage 102 are skewed at the acute angle 112 relative to each other. However, it is contemplated that the transverse passage 104 could be formed with a smooth arcuate bend. If this was done, there would be no clear point of intersection between the transverse passage 104 and central passage 102. The transverse passage 104 and central passage 102 were formed by drilling the string post 14. However, the transverse and central passages could be formed in a different manner if desired. The transverse passage 104 could extend parallel to the bottom surface 68 of the slot 44 or could diverge from the bottom surface of the slot.

Tightening the String

When the string 12 is to be tightened by utilizing the tuning device 10 to enable a musical instrument to be played, an end of the string 12 is inserted through the opening 94 (FIG. 5) to the transverse passage 104. The string 12 is pushed through the transverse passage 104 into the central passage 102. The string 12 is then pushed through the opening 96 (FIG. 1) at the lower end portion of the central passage 102. Although the string 12 could be formed of many different materials, it is believed that it will be preferred to form the string of metal.

Once the metal string 12 has been inserted through the string passage 54, the string is axially tensioned, in the manner indicated schematically by an arrow 130 in FIG. 5. The axial tension on the string 12 causes the string to be pulled into the slot 44 in the upper end portion of the string post 14. At this time, a radial central axis of the slot 44 is aligned with a location where the string 12 extends into engagement with a string support (not shown). The string support may have the same construction as disclosed in U.S. Pat. No. 5,492,044. The manner in which the string would extend from the string post 14 to the string support may be the same as is disclosed in U.S. Pat. No. 6,023,014. When the string post 14 is in the orientation illustrated in FIG. 5, the upper opening 94 to the string passage 54 faces away from the string support.

By pulling the end portion of the string 12 from the lower end portion of the string post 14 (FIG. 1), as indicated by the arrow 130 in FIG. 5, an initial relatively low tension is established in the string 12. In addition, pulling of the string 12, in the manner indicated by the arrow 130 in FIG. 5, is effective to bend the string into engagement with the upper edge 82 of the bottom 68 of the slot 44. As this occurs, the string 12 moves into the slot 44 and extends beneath the upper side 88 of the annular groove 50 in the string post.

Once the string has been initially tightened by pulling on the end of the string in the manner indicated by the arrow 130 in FIG. 5 and moved into the slot 44, the string 12 is further tightened to obtain a desired tension in the string. Further tightening of the string 12 is accomplished by rotating the knob 40. Rotation of the knob 40 rotates the worm 38 and pinion 34. The string post 14 rotates with the pinion 34.

Figure 6:
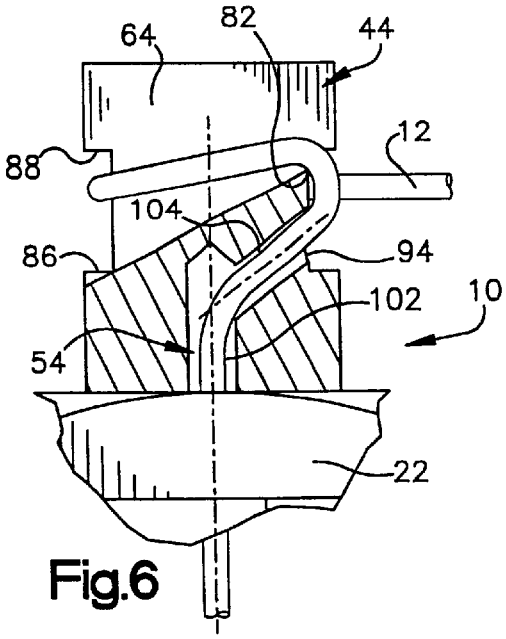
FIG. 6 is a schematic illustration depicting the manner in which the string of the musical instrument extends from the passage in the string post, through a slot in the string post, and at least part way around an annular groove in the string post.

As the string post 14 rotates with the pinion 34, the string post moves from the orientation illustrated in FIG. 5 to the orientation illustrated in FIG. 6. As this occurs, the string 12 is pulled along the bottom surface 80 of the annular groove 50. This results in the string being bent around the string post 14 in the manner illustrated in FIGS. 1, 3 and 4. The knob 40 is rotated until the desired tension is obtained in the string 12.

It is contemplated that the desired tension will be obtained in the string 12 when the string post 14 has been rotated through less than one complete revolution. This will result in the string 12 being bent or coiled only part way around the string post 14, in the manner illustrated in FIG. 3. Since the string 12 is coiled only part way around the string post 14, there will be very little or no tendency for the coil to shift during playing of the musical instrument.

Alternative Embodiment

In the embodiment of the string post illustrated in FIGS. 1–4, the upper opening 94 (FIG. 4) to the string passage 54 is aligned with the slot 44. Thus, a radial central axis of the slot 44 extends perpendicular to and intersects the central axis 60 of the string post 14. The radial central axis of the slot 44 and the central axis 60 of the string post 14 are disposed in a plane which contains the center of the upper opening 94 to the string passage 54. In the embodiment in the invention illustrated in FIG. 7, the upper opening 94 to the string passage 54 is offset from the slot 44. Thus, as viewed in FIG. 7, the upper opening 94 to the string passage 54 is angularly offset toward the left along the cylinderical bottom surface 80 of the annular groove 50.

By offsetting the upper opening 94 of the string passage 54 from the slot 44 (FIG. 7), an additional bend is obtained in the string 12. This additional bend results in the string engaging a corner formed at a intersection between the annular upper side 88 of the groove 50 and the slot 44. In addition, the string engages the upper edge or corner 82 of the slot 44. By having the string engage two corners and providing an extra bend in the string, the locking action between the string 12 and the string post 14 is increased.

Figure 7:
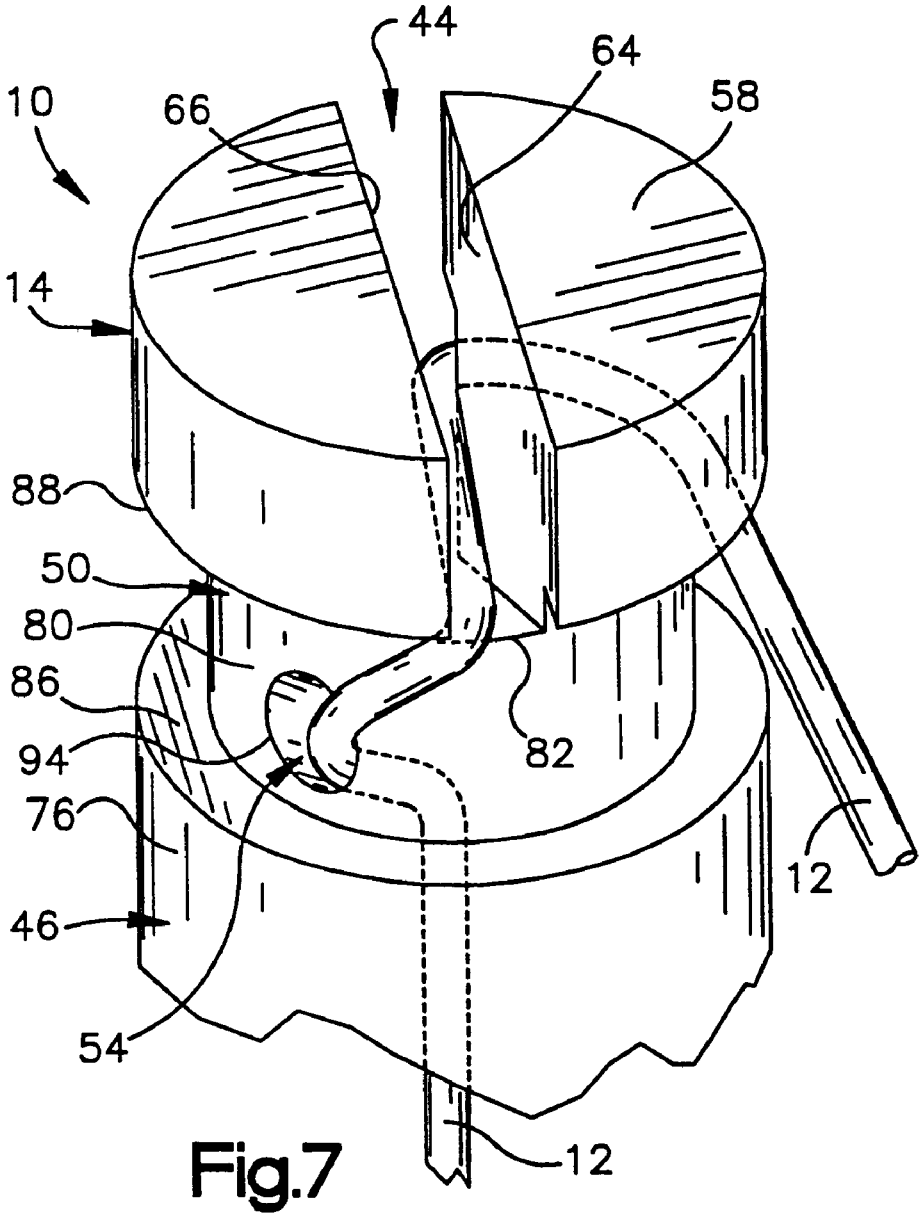
FIG. 7 is a schematic pictorial illustration, generally similar to FIG. 4, of an alternative embodiment of the string post.

In the embodiment illustrated in FIG. 7, the upper opening 94 to the string passage 54 is offset through a relatively small angular distance relative to the slot 44. However, it is contemplated that the upper opening 94 to the string passage 54 could be offset by a greater distance from the slot 44. For example, the opening 94 could be offset by 90 degrees about the groove 50 from the slot 44. Alternatively, the opening 94 could be aligned with the slot 44 at an end of the slot opposite from the upper edge or corner 82. This would result in the opening 94 being offset by 180 degrees about the annular groove 50 from the position illustrated in FIG. 4.

Conclusion

In view of the foregoing description, it is apparent that the present invention provides a tuning device 10 for a string 12 of a musical instrument. The tuning device 10 includes a string post 14. A pinion 34 is connected with a lower (as viewed in FIG. 1) end of the string post 14. A worm 38 is disposed in meshing engagement with the pinion 34. A knob 40 is connected with the worm 38 and is manually rotatable to rotate the pinion 34 and the string post 14.

A string passage 54 forms one feature of a plurality of features of the invention. The string passage 54 includes a central passage 102 which extends along a central axis 60 of the string post 14. The central passage 102 extends only part way through the string post 14. In addition, the string passage 54 includes a transverse passage 104 which intersects the central passage 102 and extends only part way through the string post 14. The transverse passage may have a central axis 106 which is skewed at an acute angle 112 relative to a central axis 60 of the central passage 102.

In accordance with another one of the features of the invention, a slot 44 extends from an upper end 58 of the string post 14. The slot 44 may have a bottom surface 68 which extends through and is skewed at an acute angle 72 to the central axis 60 of the string post 14.

In accordance with another one of the features of the invention, an annular groove 50 extends around the string post 14. The string passage 54 may have an open end 94 which is disposed in the annular groove 50. It is contemplated that, if desired, the bottom surface 68 of the slot 44 may have an end 82 which is disposed at an intersection between the slot 44 and the annular groove 50.

It should be understood that various features of the invention may be used separately or in combination with each other. For example, the string passage 54 may be utilized without the aforementioned slot 44 and annular groove 50. Alternatively, the slot 44 and/or annular groove 50 may be utilized without the string passage 54. Of course, features of the invention could be utilized in association with many different features of known devices for tuning a string of a musical instrument.

What is claimed is:

1. A device for tuning a string of a musical instrument, said device comprising a string post having first and second ends, a pinion connected to said string post at a location adjacent to said first end of said string post, a worm disposed in meshing engagement with said pinion, a central passage which extends along a central axis of said string post and extends through said pinion, said central passage extends only part way through said string post and has an end surface area disposed in said string post at a location adjacent to and spaced from said second end of said string post, a transverse passage disposed in said string post at a location adjacent to and spaced from said second end of said string post, said transverse passage extends only part way through said string post and has an end surface area disposed in said string post at a location adjacent to and spaced from said second end of said string post, said transverse passage intersects said central passage, said transverse passage and said central passage form a passage through which a string of the musical instrument extends, and a manually rotatable knob connected with said worm, said knob being manually rotatable to rotate said pinion and said string post with a portion of the string of the musical instrument extending through said central and transverse passages.

2. A device as set forth in claim 1 further including a slot which extends across said string post and extends inward from said second end of said string post, said slot extends through the central axis of said string post and is spaced from said central passage.

3. A device a set forth in claim 2 wherein said transverse passage has an opening disposed adjacent to one end of said slot.

4. A device as set forth in claim 1 further including an annular groove extending around said string post adjacent to and spaced from said second end of said string post, said transverse passage has an open end disposed in said annular groove.

5. A device as set forth in claim 1 further including a slot which extends across said string, said slot has a pair of side surfaces and a bottom surface which extends between said side surfaces, said bottom surface of said slot extends from a first end of said slot to a second end of said slot, said bottom surface of said slot slopes away from said first end of said slot toward said second end of said slot in a direction toward said second end of said string post, said transverse passage having an opening disposed adjacent to said second end of said slot.

6. A device as set forth in claim 1 wherein said transverse passage has a central axis which is skewed at an acute angle to a central axis of said central passage, said transverse passage slopes away from said central passage toward said second end of said string post.

7. A device for tuning a string of a musical instrument, said device comprising a generally cylindrical string post having first and second ends, a pinion connected to said string post at a location adjacent to said first end of said string post, a worm disposed in meshing engagement with said pinion, a slot which extends diametrically across said string post and receives a portion of a string of the musical instrument, said slot having a first side surface which extends from the second end of said string post toward the first end of said string post, a second side surface which extends from the second end of said string post toward the first end of said string post, and a bottom surface which extends between said first and second side surfaces, said bottom surface of said slot extends through and is skewed at an acute angle to a central axis of said string post, said bottom surface of said slot has a first end which is spaced a first distance from the second end of said string post and a second end which is spaced a second distance from the second end of said string post, said second distance being smaller than said first distance, a string passage at least partially disposed in said string post, said string passage having an opening which is disposed adjacent to said second end of said slot and is spaced from said bottom surface of said slot, and a manually rotatable knob connected with said worm, said knob being manually rotatable to rotate pinion and string post with a portion of a string of the musical instrument extending between the opening to the string passage and the slot.

8. A device as set forth in claim 7 wherein said string passage includes a transverse passage disposed in said string post and having a central axis which extends through said string post in a direction transverse to the central axis of said string post.

9. A device as set forth in claim 8 wherein said transverse passage extends only part way through said string post and has an end surface area disposed in said string post.

10. A device as set forth in claim 8 wherein said string passage includes a central passage which extends along a central axis of the string post and extends through said pinion, said central passage extends only part way through said string post and has an end surface area disposed in said string post at a location spaced from said bottom surface of said slot, said transverse passage intersects said central passage to enable the string of the musical instrument to extend through the slot and into the transverse and central passages during rotation of the string post.

11. A device as set forth in claim 7 wherein said string passage extends through said pinion.

12. A device as set forth in claim 7 wherein said bottom surface of said slot is flat and extends perpendicular to said first and second surfaces of said slot.

13. A device as set forth in claim 7 wherein said string post has an annular groove which extends around said string post, said second end of said bottom surface of said slot being disposed at an intersection of said bottom surface of said slot and said annular groove.

14. A device as set forth in claim 13 wherein said opening to said string passage is disposed in said annular groove.

15. A device for tuning a string of a musical instrument, said device comprising a string post having first and second ends, a pinion connected to said string post at a location adjacent to a first end of said string post, a worm disposed in meshing engagement with said pinion, an annular groove which extends around said string post at a location spaced from the second end of said string post, a slot which extends inward from said second end of said string post and extends across said string post, a string passage which is at least partially disposed in said string post and extends through said pinion, said string passage is spaced from said slot and has an opening disposed in said annular groove, and a manually rotatable knob connected with said worm, said knob being manually rotatable to rotate said pinion and string post with a portion of a string of the musical instrument extending from the groove in said string post into the slot in said string post and extending from the slot in said string post into the string passage.

16. A device as set forth in claim 15 where said slot has a first side surface which extends from the second end of said string post toward the first end of said string post, a second side surface which extends from the second end of said string post, and a bottom surface which extends between said first and second side surfaces.

17. A device as set forth in claim 16 wherein at least one end of said bottom surface of said slot is disposed at an intersection between said slot and said annular groove.

18. A device as set forth in claim 16 wherein opposite ends of said bottom surface of said slot are disposed adjacent to said annular groove.

19. A device as set forth in claim 16 wherein said bottom surface of said slot extends through and is skewed at an acute angle to a central axis of the string post, said bottom surface of said slot has a first end which is spaced a first distance from the second end of said string post and a second end which is spaced a second distance from the second end of said string post, said second distance being smaller than said first distance.

20. A device as set forth in claim 16 wherein said side surfaces of said slot extend parallel to a central axis of said string post.

21. A device as set forth in claim 15 wherein said string passage includes a central passage which extends along a central axis of said string post and extends through said pinion, said central passage extends only part way through said string post and has an end surface area disposed in said string post at a location spaced from said slot and from said second end of said string post, said string passage also includes a transverse passage disposed in said string post, said transverse passage extends only part way through said string post and has an open end disposed in said annular groove, said transverse passage intersects said central passage.

22. A device as set forth in claim 21 wherein said transverse passage has a central axis which is skewed at an acute angle to a central axis of said central passage, said transverse passage slopes away from said central passage toward said second end of said string post.

23. A device for tuning a string of a musical instrument, said device comprising a generally cylindrical string post having first and second ends, a pinion connected to said string post at a location adjacent to a first end of the string post, a worm disposed in meshing engagement with said pinion, an annular groove which extends around said string post at a location spaced from the second end of said string post, a slot which extends diametrically across said string post and receives a portion of a string of the musical instrument, said slot having a first side surface which extends from the second end of said string post toward the first end of said string post, a second side surface which extends parallel to said first side surface of said slot and extends from said second end of said string post toward said first end of said string post, and a bottom surface which extends between said first and second side surfaces and extends through a central axis of said string post, said bottom surface of said slot is skewed at an acute angle to the central axis of said string post, said bottom surface of said slot has a first end which is spaced a first distance from the second end of said string post and a second end which is spaced a second distance from the second end of said string post, at least one of said first and second ends of said slot is disposed at an intersection between said slot and said annular groove, a string passage which is at least partially disposed in said string post and extends through said pinion, said string passage includes a central passage and a transverse passage, said central passage extends only part way through said string post and extends through said pinion, said central passage has an end surface area disposed in said string post at a location adjacent to and spaced from said bottom surface of said slot, said transverse passage extends only part way through said string post from an opening in said annular groove to said central passage, said transverse passage has a central axis which is skewed at an acute angle to the central axis of said string post and slopes away from said central passage toward said second end of said string post, and a manually rotatable knob connected with said worm, said knob being manually rotatable to rotate said pinion and string post with a portion of a string of the musical instrument extending through said central and transverse passages, into said slot, and into said annular groove.

* * * * *